US006280648B1

(12) United States Patent
Konzelman et al.

(10) Patent No.: US 6,280,648 B1
(45) Date of Patent: Aug. 28, 2001

(54) STAIN RESISTANT COMPOSITION FOR POLYAMIDE CONTAINING SUBSTRATES

(75) Inventors: Jim Konzelman, Athens, GA (US); David A. MacEwen, Greenville; Robert B. Login, Simpsonville, both of SC (US)

(73) Assignee: Sybron Chemicals, Inc., Wellford, SC (US)

( * ) Notice: Subject to any disclaimer, the term of this patent is extended or adjusted under 35 U.S.C. 154(b) by 0 days.

(21) Appl. No.: 09/176,072

(22) Filed: Oct. 20, 1998

(51) Int. Cl.[7] ..... D06M 9/00

(52) U.S. Cl. ..... 252/8.61; 252/8.62; 8/115.62; 8/115.64; 8/557; 8/560; 8/589

(58) Field of Search ..... 8/115.62, 115.64, 8/557, 560, 589; 252/8.61, 8.62

(56) References Cited

U.S. PATENT DOCUMENTS

| | | | | |
|---|---|---|---|---|
| 4,501,591 | | 2/1985 | Ucci et al. . | |
| 4,592,940 | | 6/1986 | Blyth et al. . | |
| 4,680,212 | | 7/1987 | Blyth et al. . | |
| 4,822,373 | | 4/1989 | Olson et al. . | |
| 4,883,839 | | 11/1989 | Fitzgerald et al. . | |
| 4,937,123 | | 6/1990 | Chang et al. . | |
| 4,940,757 | | 7/1990 | Moss, III et al. . | |
| 4,948,650 | | 8/1990 | Fitzgerald et al. . | |
| 4,963,409 | * | 10/1990 | Liss et al. | 428/96 |
| 5,001,004 | | 3/1991 | Fitzgerald et al. . | |
| 5,032,136 | | 7/1991 | Fitzgerald et al. . | |
| 5,057,121 | | 10/1991 | Fitzgerald et al. . | |
| 5,061,763 | | 10/1991 | Moss, III et al. . | |
| 5,074,883 | | 12/1991 | Wang . | |
| 5,110,317 | | 5/1992 | Hangey et al. . | |
| 5,145,487 | | 9/1992 | Hangey et al. . | |
| 5,152,803 | | 10/1992 | Hangey et al. . | |
| 5,230,708 | | 7/1993 | Hangey et al. . | |
| 5,328,766 | * | 7/1994 | Smith | 428/378 |
| 5,346,726 | | 9/1994 | Pechhold . | |
| 5,356,689 | | 10/1994 | Pechhold . | |
| 5,358,769 | | 10/1994 | Pechhold . | |
| 5,447,755 | | 9/1995 | Pechhold et al. . | |
| 5,460,887 | | 10/1995 | Pechhold . | |
| 5,574,106 | | 11/1996 | Allen . | |
| 5,629,376 | | 5/1997 | Sargent et al. . | |
| 5,654,068 | | 8/1997 | Pechhold . | |
| 5,708,087 | | 1/1998 | Buck et al. . | |
| 5,759,431 | * | 6/1998 | Nguyen | 252/8.62 |

FOREIGN PATENT DOCUMENTS

| | | |
|---|---|---|
| 1183086 | 3/1970 | (DE) . |
| 0333500A2 | 9/1989 | (EP) . |

* cited by examiner

*Primary Examiner*—Gregory Delcotto
(74) *Attorney, Agent, or Firm*—Dority & Manning, P.A.

(57) ABSTRACT

A stain blocking composition for treating polyamide materials, such as nylon carpeting is disclosed. The stain blocking composition contains one or more novolak resins in combination with an addition polymer and a metal donor, such as a magnesium salt. The addition polymer is directed to a partially sulfonated styrene-maleic copolymer. The addition polymer not only serves as a stain blocking composition but also serves to reduce the yellowing effect sulfonated novolak resins may have on polyamide substrates. Besides containing a sulfonated novolak resin and the addition polymer, the composition of the present invention can include various other ingredients. For instance, the composition can contain an emulsifier or dispersant, antioxidants such as sodium thiocyanate or fluorocarbon repellents or mixtures thereof.

32 Claims, No Drawings

STAIN RESISTANT COMPOSITION FOR POLYAMIDE CONTAINING SUBSTRATES

FIELD OF THE INVENTION

The present invention generally relates to a stain resistant composition for polyamide substrates and to a process for making and applying the composition. More particularly, the present invention is directed to combining an addition polymer which comprises a partially sulfonated styrene-maleic copolymer with one or more sulfonated novolak resins.

BACKGROUND OF THE INVENTION

Polyamide fibers, such as nylon fibers, are useful in producing many different and various textile products. In particular, polyamide fibers are well suited for constructing carpeting. For instance, nylon carpeting is durable, has good aesthetic properties and is relatively inexpensive. Further, nylon carpeting is very receptive to acid dyes and thus can be produced in a wide variety of colors.

Unfortunately, nylon carpeting and other polyamide products are susceptible to staining. For example, many food and beverage items, such as coffee, fruit juices, and wine, contain natural ingredients which can bind to dye sites located on polyamide materials. Further, many artificial colorants and pigments that are added to food and beverage products can also permanently stain polyamide fibers. Such colorants and pigments are typically added to powdered drink mixes, to gelatin desserts, and to various soft drinks.

In the past, many attempts have been made to make stain resistant polyamide fibers and, in particular, to produce stain resistant carpeting. For instance, in the past, carpet fibers have been coated with liquid resistant coatings which inhibit wetting of the carpet surface. These coatings, however, have a tendency to wear off over time.

In the past, polyamide carpet fibers have also been treated with stain blocking compositions that actually bind to available dye sites that remain on the fibers after the fibers have been dyed a particular color. For example, various sulfonated novolak resins have been used for this purpose. Novolak resins include syntans, resoles and generally comprise sulfonated phenol and napthalene formaldehyde condensates. In the past, sulfonated novolak resins have proven to be very effective in providing polyamide materials with stain resistant characteristics. Unfortunately, however, novolak resins have a tendency to discolor when exposed to sunlight or other sources of ultraviolet light. As a result, polyamide materials treated with sulfonated novolak resins, such as carpeting, can yellow or otherwise discolor over time. As such, a need currently exists for an improved stain blocking composition for polyamide materials that binds to available dye sites but does not significantly cause discoloration of the materials after application. Specifically, it would be particularly desirable if a stain blocking agent could be fabricated that would work in conjunction with sulfonated novolak resins in a manner so as to decrease the amount used and hence decrease discoloration when exposed to light.

SUMMARY OF THE INVENTION

The present invention recognizes and addresses the foregoing drawbacks and deficiencies of prior art constructions and methods.

Accordingly, it is an object of the present invention to provide an improved stain blocking composition for treating polyamide materials for making the materials stain resistant.

Another object of the present invention is to provide a stain blocking composition that can work in conjunction with sulfonated novolak resins in rendering polyamide materials stain and light resistant.

It is another object of the present invention to provide a stain blocking composition for polyamides that contains a partially sulfonated styrene-maleic copolymer.

Still another object of the present invention is to provide a stain blocking composition for polyamides, such as nylon and nylon blends, that contains a partially sulfonated styrene-maleic copolymer formed by sulfonating and hydrolyzing a styrene-maleic anhydride copolymer.

Another object of the present invention is to provide a stain blocking composition for treating polyamides that contains at least one sulfonated novolak resin, a partially sulfonated styrene-maleic copolymer, a dispersant, fluorocarbon repellents, and a magnesium salt.

These and other objects of the present invention are achieved by providing a stain blocking composition adapted to bind to available dye sites contained in a polyamide material for making the polyamide material stain resistant. The composition includes a sulfonated novolak resin and an addition polymer. Specifically, the addition polymer is a partially sulfonated styrene-maleic copolymer. For instance, from about 2 mole percent to about 20 mole percent of the styrene units contained within the styrene-maleic copolymer can be sulfonated. In one preferred embodiment, 10 mole percent or less of the styrene units are sulfonated.

The molar ratio of styrene to maleic acid contained within the copolymer can be in a range of from about 1:1 to about 3:1 respectively. In most applications, the partially sulfonated styrene-maleic copolymer contains maleic acid in an amount from about 25 mole percent to about 50 mole percent, styrene in an amount from about 50 mole percent to about 75 mole percent, and sulfonated styrene in an amount from about 2 mole percent to about 20 mole percent based on the styrene charge.

In one embodiment, the partially sulfonated styrene-maleic copolymer can be formed by partially sulfonating a styrene-maleic anhydride copolymer and then later hydrolyzing the copolymer with water and a metal base, such as sodium hydroxide or potassium hydroxide. In this embodiment, a metal salt of a partially sulfonated styrene-maleic copolymer is formed and used as the addition polymer. According to this process, the sulfonate groups are believed to be randomly distributed throughout the polymer. Further, the sulfonate groups are usually either in the ortho or the para position.

More particularly, in one embodiment, the partially sulfonated styrene-maleic copolymer can be formed by first dissolving a styrene-maleic anhydride copolymer in a solvent, such as 1,2-dichloroethane, in order to form a polymer solution. A variety of sulfonating agents, such as sulfuric acid, sulfur trioxide, oleum, and other suitable agents can be added to the polymer solution in an amount sufficient to sulfonate from about 2 mole percent to about 20 mole percent of the styrene contained in the copolymer. Once the copolymer is sulfonated, water and a metal hydroxide are then added to the solution to form a metal salt of the partially sulfonated styrene-maleic copolymer. Once the copolymer is hydrolyzed, the solvent can be removed by distillation. If desired, an acid can then be added to the resulting polymer solution to lower the pH. Once the pH has been adjusted, the solution is ready for use in the composition of the present invention.

When applied to a polyamide material, the sulfonated novolak resin and the addition polymer of the present invention can be contained within an aqueous solution or bath. For instance, the sulfonated novolak resin can be present in an amount from 0.5 grams/liter to 2 grams/liter, while the addition polymer can be present in the solution in an amount from about 4 grams/liter to 8 grams/liter.

Besides containing a sulfonated novolak resin and the addition copolymer, the composition of the present invention can include various other ingredients that facilitate application or otherwise assist in rendering a polyamide material stain resistant. For instance, dispersants and emulsifiers can be included within the composition of the present invention. In one embodiment, an arylalkyl sulfonate salt can be added to the composition, such as Tanapure™ AC and Dowfax™2A1.

Preferably, the composition of the present invention further contains a metal donor, such as a magnesium salt, which facilitates application of the addition polymer to the polyamide substrate. For example, magnesium salts that may be included in the composition include magnesium chloride, magnesium acetate, magnesium nitrate, magnesium sulfamate, magnesium dihydrogen phosphate, magnesium sulfate, and mixtures thereof. The magnesium salt can be present in the bath in an amount of at least 2 grams per liter, and particularly in an amount of at least 3 grams per liter. When present in the bath, it has been unexpectedly discovered that application of the composition to polyamide fibers can occur at higher pHs, such as at a pH greater than about 6. Thus, when a metal donor is present in the composition, the pH of the composition may not have to be adjusted. Compatible fluorocarbons can also be present either in the formulation or in the treatment bath.

These and other objects of the present invention are also achieved by providing a stain resistant polyamide product, such as carpeting. The product includes a polyamide substrate and a stain blocking composition that is bound to available dye sites located on the polyamide substrate. The stain blocking composition can include, for instance, at least one sulfonated novolak resin in combination with an addition polymer. The addition polymer can comprise a partially sulfonated styrene-maleic copolymer. The styrene-maleic copolymer can have the following repeat units:

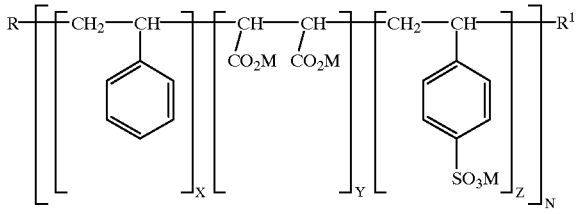

wherein:

X, Y and Z Typical Mole Ratios are:

X=1–3

Y=1

Z=X (0.02–0.2)

Typical Repeat Units are:

N=4–24 and wherein:

$R=R^1$ or $R\neq R^1$

R & $R^1$ are initiating free-radical fragments or cumene or hydrogen and wherein:

M is a metal ion such as sodium

Other objects, features and aspects of the present invention are discussed in greater detail below.

DETAILED DESCRIPTION OF PREFERRED EMBODIMENTS

It is to be understood by one of ordinary skill in the art that the present discussion is a description of exemplary embodiments only and is not intended to limit the broader aspects of the present invention, which broader aspects are embodied in the exemplary construction.

In general, the present invention is directed to a stain blocking composition particularly well suited for treating polyamide materials in making them stain resistant. Specifically, once applied to a polyamide substrate, the composition of the present invention binds to available dye sites, preventing the dye sites from bonding to pigments or colorants to which the polyamide material may be exposed. Further, the composition of the present invention allows for the use of smaller than usual amounts of sulfonated novolak resins without the associated discoloration problems experienced in the past when the polyamide material is later exposed to light.

In general terms, the stain blocking composition of the present invention includes at least one sulfonated novolak resin combined with an addition polymer. In accordance with the present invention, the addition polymer is a partially sulfonated styrene-maleic copolymer. The addition polymer not only binds to available dye sites on polyamide substrates, but has also been discovered to reduce the tendency of polyamide substrates to photo-yellow after having been treated with a sulfonated novolak resin. Specifically, it is believed that the partially sulfonated styrene-maleic copolymer extends the sulfonated novolak resin decreasing the amount required and hence reducing yellowing potential of the stain blocking composition.

The sulfonated novolak resin and the addition polymer of the present invention can be contained in an aqueous solution prior to application to a polyamide material. For example, one or more sulfonated novolak resins can be present in the solution bath from 0.5 grams/liter up to about 2 grams/liter, and particularly in an amount of about 1 to 1.5 grams/liter. The partially sulfonated styrene-maleic copolymer, on the other hand, can be present in the treatment solution in an amount from about 4 to 8 grams/liter, and particularly in an amount from about 5 to 7 grams/liter. Those skilled in the art of stain blocking nylon carpets might even use less with heavy shades. Therefore, the above are guidelines for light to medium shades. During application, the aqueous solution can have a pH of less than about 7, and particularly at a pH of from about 6 to about 1.5. Besides the sulfonated novolak resin and the addition polymer, a metal donor, such as a magnesium salt can be present within the solution for facilitating application of the novolak resin and addition polymer to the polyamide material.

As used in the present application, a novolak resin generally refers to a sulfonated phenol formaldehyde condensate such as those based on syntans and resoles. In general, any stain blocking novolak resin may be used in the composition of the present invention and combined with the addition polymer. Particular examples include diphenolic sulfones, and particularly sulfonated naphthalene condensates. A particular sulfonated novolak resin well suited for use in the present invention contains a condensation product of 4,4'dihydroxysulfone, formaldehyde and sulfonated naphthalene. Other novolak resins which may be used in the present invention include those disclosed in U.S. Pat. Nos. 5,501,591, 5,592,940, 4,680,212, 4,822,373, 4,937,123, 5,447,755, 5,654,068, 5,708,087, 5,707,708, 5,074,883, 4,940,757, 5,061,763, 5,629,376, which are all incorporated herein by reference in their entireties.

The addition polymer of the present invention, as described above, is a partially sulfonated styrene-maleic copolymer. In particular, the styrene-maleic copolymer is sulfonated to an extent such that from about 2 mole percent to about 20 mole percent of the styrene groups contained within the copolymer are bound to a sulfonate group. More particularly, for most applications, from about 5 mole percent to about 10 mole percent of the styrene groups contained within the copolymer are sulfonated.

The styrene-maleic copolymer incorporated into the addition polymer of the present invention contains styrene and maleic acid in a molar ratio ranging from about 1:1 to about 3:1 respectively. The copolymer itself, prior to sulfonation, can have a molecular weight of from about 1,000 to about 50,000.

In one exemplarily embodiment, the partially sulfonated styrene-maleic copolymer of the present invention contains from about 25 mole percent to about 50 mole percent maleic acid, from about 50 mole percent to about 75 mole percent styrene, and from about 2 mole percent to about 20 mole percent sulfonated styrene based on the total styrene in the polymer. More particularly, maleic acid can be contained within the copolymer in an amount from about 25 mole percent (1:3 maleic acid to styrene) to about 50 mole percent (1:1 maleic acid to styrene), while styrene can be contained within the copolymer in an amount from about 50 mole percent to about 75 mole percent.

Preferably, the partially sulfonated styrene-maleic copolymer is formed initially from a styrene-maleic anhydride copolymer which is subsequently sulfonated using a sulfonating agent, such as sulfuric acid, oleum, sulfur trioxide, and the like. Once the styrene-maleic anhydride copolymer is partially sulfonated, the polymer can then be hydrolyzed which converts the maleic anhydride contained within the copolymer into maleic acid. In most instances, during hydrolysis, a metal salt of the partially sulfonated styrene-maleic copolymer is formed, such as the sodium or potassium salt. After hydrolysis, the copolymer can be neutralized and used as desired. Ultimately, a water soluble terpolymer is formed. This aqueous polymer has the ability to resist precipitation at low The styrene-maleic anhydride copolymer that is partially sulfonated according to the present invention generally has the following formula:

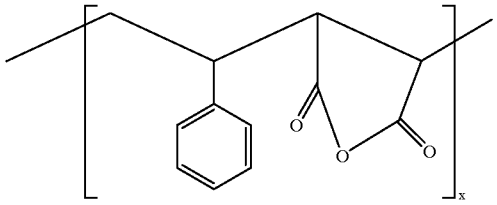

Copolymers having the above formula can be obtained commercially from Elf-Atochem of Birdsboro, Pennsylvania under product designations SMA-1,000, SMA-2,000 or SMA-3000 (1,000–3,000 designations indicating 1:1 to 1:3 maleic anhydride to styrene mole ratios). SMA-1000 is a copolymer of approximately 1600 molecular weight (number average) containing a 1:1 mole ratio of styrene:maleic anhydride, having approximately 6–8 units of each monomer, with an acid number averaging 480. SMA-2000 is a copolymer of approximately 1700 molecular weight containing a 2:1 mole ratio of styrene:maleic anhydride, having approximately 6–8 units of each monomer with an acid number averaging 355. SMA-3000 is a copolymer of approximately 1900 molecular weight containing a 3:1 mole ratio of styrene:maleic anhydride, having approximately 6–8 units of each monomer, with an acid number averaging 285. In general, the molecular weight of the above copolymer can be up to about 50,000, and particularly from about 1,000 to about 10,000.

Styrene-maleic anhydride copolymers can be formed according to various processes. For instance, in one embodiment, the copolymer can be formed by combining in a reactor under an inert atmosphere, such as a nitrogen atmosphere, a solvent, a free radical initiator, and a monomer solution containing maleic anhydride and styrene dissolved in the above solvent.

The solvent selected for the polymerization process is preferable inert and will not adversely interfere with the formation of the copolymer. The solvent should also be anhydrous and should be capable of solubilizing both the monomer blend and the resulting polymer that is formed. Preferably, a solvent is selected that can also be present during sulfonation.

Examples of solvents that may be used in the present invention include chlorinated solvents, such as 1,2-dichloroethane, dichloromethane, carbontetrachloride, and 1,2-dichloropropane. Various nonchlorinated solvents may also be used including aromatics such as toluene, xylene or hydrocarbons such as cyclohexane, octane or ethers such as tetrahydrofuron.

The free radical initiator present within the reactor initiates the polymerization reaction. The particular initiator used in the present invention will depend generally on the process conditions. One particular example of a free radical initiator that may be used is azobisisobutylnitrile (AIBN).

In order to form the styrene-maleic anhydride copolymer, a reactor can be heated to a temperature such as from about 80° C. to about 85° C., and the reactants can be slowly added over, for instance, a two to six hour period. Once contained in the reactor, the components can be heated for an additional two hours in order to ensure complete consumption of the monomers. Also, additional initiator can be added in order to consume any residual monomers. If desired, a chain transfer agent, such as cumene, can further be added to the reactor to reduce molecular weight.

Once the styrene-maleic anhydride copolymer is formed, such as through the above process, or otherwise obtained, the copolymer is partially sulfonated. In order to sulfonate the copolymer, for instance, the copolymer can be dissolved in one of the above described solvents. At low heat, such as at a temperature of about 35° C., a sulfonating agent can be slowly added to the polymer solution. The sulfonating agent can be, for instance, sulfur trioxide, oleum, sulfuric acid, a sulfur trioxide complex, or mixtures thereof.

Sulfur trioxide is perhaps the most efficient sulfonating agent available. Sulfur trioxide, however, can be difficult to handle. Particular sulfonating agents that have been well suited for use in the present invention include oleum, a mixture of sulfuric acid and sulfur trioxide.

Once the sulfonating agent is added to the styrene-maleic anhydride copolymer solution, the solution is preferably heated for a time sufficient for sulfonation to be completed. For instance, when combining the copolymer with sulfuric acid, the solution can be heated to a temperature of about 70° C. When using oleum and sulfur trioxide as the sulfonating agent, however, the solution can be heated to a lower temperature, such as about 40° C.

As described above, during sulfonation, preferably less than about 20 mole percent of the total styrene aromatic groups contained within the styrene-maleic anhydride copolymer are sulfonated, and particularly less than about 10% are sulfonated. In one preferred embodiment, the styrene-maleic anhydride copolymer is dissolved in 1,2-dichloroethane during sulfonation. When dissolved in 1,2-dichloroethane, the styrene-maleic anhydride copolymer precipitates out of solution as the copolymer is sulfonated. Of particular advantage, it has been discovered that the copolymer will precipitate out of solution before 20 mole percent of the styrene contained in the copolymer is sulfonated. However, this does not impair the overall sulfonation reaction.

Sulfonating the styrene anhydride copolymer creates the stain blocking characteristics of the polymer composition. Of particular importance to the present invention, the styrene-maleic anhydride copolymer is post-sulfonated meaning that the copolymer is sulfonated after the copolymer has been formed instead of forming the copolymer with a pre-sulfonated styrene monomer. The process of the present invention results in a unique partially sulfonated copolymer in which the sulfonate groups are distributed throughout the polymeric structure. In particular, it is believed that the process of the present invention produces a styrene-maleic anhydride copolymer in which sulfonate groups are located both in the para position and the ortho position on the aromatic moieties. Further, it is believed that predominately monosulfonated styrene groups are formed during sulfonation. It is believed that randomly sulfonating the styrene-maleic anhydride copolymer results in a composition having superior stain blocking characteristics over sulfonated polymers wherein the sulfonate groups are not randomly dispersed.

Once the styrene-maleic anhydride copolymer is partially sulfonated according to the present invention, the copolymer is neutralized and hydrolyzed by combining the polymer with water and a metal base, such as sodium hydroxide. In particular, water can be added to the partially sulfonated copolymer followed by a water soluble base. The water hydrolyzes the maleic anhydride contained within the polymer to form maleic acid. The base is then added to neutralize any excess acid contained within the solution that remains from the sulfonation process. The base also neutralizes the arylsulfonates and the maleic acid contained with the partially sulfonated copolymer. In this soluable form, the polymer is easily formulated with the other key ingredients and can be adjusted to low pH and remain compatible with metal donors, such as magnesium chloride.

In one embodiment, the base is added until the pH of the solution stabilizes, which is typically at a pH of greater than about 8. At this point, the organic solvent can be removed using various separation techniques. For most applications, the solvent can be removed, recovered and reused after appropriate mark-up.

Once hydrolyzed and neutralized, the partially sulfonated styrene-maleic copolymer generally has the following formula:

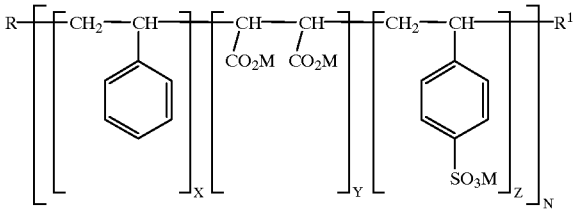

wherein:

X, Y and Z Typical Mole Ratios are:

X=1–3

Y=1

Z=X (0.02–0.2)

Typical Repeat Units are:

N=4–24 and wherein:

$R=R^1$ or $R\neq R^1$

R & $R^1$ are initiating free-radical fragments or cumene or hydrogen and wherein:

M is a metal ion such as sodium

After hydrolysis and neutralization, the partially sulfonated styrene-maleic copolymer can then be combined with other ingredients and components in formulating the composition of the present invention. For instance, in one embodiment, a surfactant or dispersant can be added to the partially sulfonated styrene-maleic copolymer followed by an acid if desired in an amount sufficient to lower the pH of the solution to less than about 4, and in particular less than about 2. An acid that may be added to the solution is, for instance, sulfamic acid. It should be understood, however, that adding an acid to adjust the pH of the solution may not be necessary in some applications. The surfactant, on the other hand, that may be combined with the copolymer can be, for instance, an alkali salt of a disulfonated akylated diphenyloxide.

One or more sulfonated novolak resins can be added to the solution. The amount of water contained within the solution can be adjusted to arrive at an appropriate solids level.

Preferably, a metal donor, such as a magnesium salt, is also added to the solution bath in order to facilitate application of the stain blocking materials to a polyamide substrate. The metal donor can be, for instance, magnesium chloride, magnesium acetate, magnesium nitrate, magnesium sulfamate, magnesium dihydrogen phosphate, magnesium sulfate, and mixtures thereof. Other salts can be considered such as those based on aluminum. It is believed that the magnesium salt forms a resonance structure with the polyamide substrate, making the polyamide material more cationic in character. By increasing the cationic charge of the polyamide, a greater attraction is formed with the stain blockers, which are primarily anionic in character. The metal donors can be added to the solution in an amount of at least 2 grams per liter, and particularly in an amount of at least 3 grams per liter.

When present in the solution, the metal donor has also unexpectedly been found to eliminate the necessity of lowering the pH of the solution for some applications. In particular, it has been discovered that the solution can be applied to polyamides at pHs as great as about 6.

Besides a sulfonated novolak resin and the above metal donor, various other ingredients and components can also be added to the aqueous solution. For instance, in one preferred embodiment, a dispersant or emulsifier can be added such as an arylalkyl sulfonate salt.

Additionally, in a further alternative embodiment of the present invention, a fluorocarbon polymer can also be added to the solution that is applied to the polyamide. The fluorocarbon polymer forms a coating on the polyamide making the polymer more water repellent. Of particular advantage, it has been discovered that the fluorocarbon repellents can be combined with the composition and applied in a single step instead of having to be applied later in the process. Specifically, it has been discovered that the composition of the present invention is completely compatible with fluorocarbon repellents. In the past, difficulties have been experienced in applying stain blocking compositions in combination with fluorocarbon polymers.

In one preferred embodiment, the composition of the present invention includes the following ingredients:

TABLE I

| Component | Weight % in Final Product |
|---|---|
| 23% solids, basic solution of an alkali salt of the partially sulfonated styrene-maleic acid copolymer (2 to 1 mole ratio) | 67.0 |
| Tanapure AC, surfactant available from Sybron Chemicals, Inc., 45% aqueous solution of an alkali salt of a branched $C_{12}$ disulfonated diphenyloxide | 19.0 |
| Dyeweld ST sulfonated novolak resin available from Sybron Chemicals, Inc., a 35% aqueous solution of a sulfonated napthalene condensate with 4,4' dihydoxysulfone and formaldehyde | 14.0 |
| | 100.0 |

The composition of the present invention as described above is well suited for treating polyamide materials for providing the polyamide materials with stain resistant properties. In particular, the composition binds to available dye sites contained within the polyamide which prevent dyes or colorants accidentally spilled on the polymer from leaving a permanent stain. The composition is particularly well suited to treating nylon carpeting. Besides carpeting, the stain blocking composition of the present invention can also be used on upholstery fabrics, casual outerwear, jackets, ski wear, etc.

The composition of the present invention can be applied to polyamide substrates in various manners. For instance, the polyamide substrates can be dipped into a bath containing the stain blocking composition. In an alternative embodiment, a solution containing the stain blocking composition can be pressurized with steam and then sprayed on the polyamide substrate in the form of a foam.

The present invention may be better understood with reference to the following examples.

EXAMPLE 1

The following represents one procedure for generating a stain blocking composition in accordance with the present invention.

350 gm. of 1,2-dichloroethane (DCE) is added to a 2 L. four neck flask equipped with a mechanical stirrer, nitrogen inlet, and temperature controller. 11.9 gm of azobisisobutylnitrile (AIBN) are added to the flask with stirring. A slow steady purge of nitrogen is turned on and the reactor heated to reflux, 83° C. A monomer and an initiator solution are then added from separate addition funnels simultaneously over 4 hrs. The monomer solution consists of 196 gm maleic anhydride and 208 gm of styrene dissolved in 713 gm of DCE. The initiator solution is 61 gm of AIBN and 17.5 gm of cumene dissolved in 425 gm of DCE. After both solutions are added, the reaction flask is refluxed for two additional hours. If any unreacted monomer is detected, additional initiator is added and the reaction heated for an additional hour.

The reactor is then cooled to 35° C., and 58.8 gm of 30% oleum is added over a 4 hr. period from an addition funnel equipped with a metering valve. At this point the polymer precipitates from solution. The reaction mixture is then heated to 70° C. for 1 hr. The mixture is neutralized at 50° C. with the addition of 800 gm of water with 240 gm of 50% caustic.

The DCE is removed through azeotropic distillation which requires the addition of 1391 gm of water. Once the DCE is removed the polymer solution is formulated with the addition of 2 Kg of water, 923.1 gm of Tanapure AC (surfactant available form Sybron Chemicals, Inc.). The pH of the solution is lowered to below 2 with 320 gm of sulfamic acid 166 gm of DYEWELD ST a sulfonated novolak type resin (available from Sybron Chemicals, Inc.) and 31.5 gm of a 35% sodium thiocyanate solution are then added. The solids are adjusted to 26% with water.

EXAMPLE 2

The following is an alternative embodiment of a process for formulating a stain blocking composition in accordance with the present invention.

500 gms of SMA-1,000 (a 1:1 molar ratio styrene:maleic anhydride copolymer available from Elf-Atochem) is dissolved in 1488 gm of 1,2-dichloroethane (DCE) in a 2 L four neck flask equipped with a mechanical stirrer, nitrogen inlet, and temperature controller. The solution is heated to 35–40° C. and 58.8 gm of 30% oleum is added over a 4 hr. period from an addition funnel equipped with a metering valve. At this point the polymer precipitates from solution.

The reaction mixture is then heated to 70° C. for 1 hr. The mixture is neutralized at 50° C. with the addition of 800 gm of water and 240 gm of 50% caustic. The DCE is removed through azeotropic distillation which requires the addition of 1391 gm. of water.

Once the DCE is removed the polymer solution is formulated with the addition of 2 Kg of water and 923.1 gm of Tanapure AC (surfactant available form Sybron Chemicals, Inc.). The pH of the solution is lowered to below 2 with 320 gm of sulfamic acid. 166 gm of DYEWELD ST (a sulfonated novolak type resin available from Sybron Chemicals, Inc.) and 31.5 gm of a 35% sodium thiocyanate solution are then added. The solids are adjusted to 26% with water.

EXAMPLE 3

This example demonstrates a further alternative embodiment for formulating a stain blocking composition in accordance with the present invention.

500 gms of SMA-1,000 styrene-maleic anhydride copolymer is dissolved in 2,000 gm of 1,2-dichloroethane (DCE) in a 3 L four neck flask equipped with a mechanical stirrer, nitrogen inlet, and temperature controller. Under nitrogen the solution is heated to 70 C. and 72.75 gm of 99% sulfuric acid is added over a 4 hr. period from an addition funnel equipped with a metering valve. At this point the polymer precipitates from solution.

The reaction mixture is then heated to 70° C. for 4 hr. The mixture is neutralized at 50° C. with the addition of 800 gm of water and 240 gm of 50% caustic. The DCE is removed through azeotropic distillation which requires the addition of 1,391 gm of water. Once the DCE is removed the polymer solution is formulated with the addition of 2 Kg of water, 923.1 gm of TANAPURE™ AC (surfactant available form Sybron Chemicals, Inc.). The pH of the solution is lowered to below 2 with 320 gm of sulfamic acid 166 gm of DYEWELD ST (a sulfonated novolak type resin available from Sybron Chemicals, Inc.) and 31.5 gm of a 55% sodium thiocyanate solution are then added. The solids are adjusted to 26% with water.

EXAMPLE 4

The following example is a further alternative embodiment of a process for producing a composition made in accordance with the present invention. In this example, the quantities of ingredients have been increased to reflect commercial level production.

A glass-lined reactor is charged with 2,000 pounds of 1,2-dichloroethane (DCE) and 255 pounds of SMA 2000 resin (Elf-Atochem). The mixture is stirred, slowly sparged with nitrogen and heated to 35–40° C. At this point, 37 pounds of 30% oleum is added over a two hour period. The temperature is raised to 60–70° C. and held there for four hours. At the end of the sulfonation step, 1275 pounds of water and 130 pounds of 50% caustic are added at less than 50° C. followed by an additional 1275 pounds of water. The mixture is heated to 85–100° C. while an azeotrope of DCE/water is taken overhead. After 8 hours, all of the original DCE has been recovered. Solids and pH are adjusted to approximately 25% and 9–10, respectively. The polymer solution is now ready to be combined with other ingredients and formulated into the final product.

EXAMPLE 5

The following example was performed in order to determine the amount of sulfonation that occurred in producing a composition made in accordance with the present invention.

The process generally described in Example 4 above was used to produce a partially sulfonated styrene-maleic copolymer in accordance with the present invention. The amounts of reactants used to produce the polymer are listed in the table below.

After the polymer was formed, a determination of the amount of sulfate contained within the polymer was performed using potentiometry. Specifically, the concentration of sulfate ions was determined by precipitation titration in a partially non-aqueous solution containing lead perchlorate by using a lead ion selective electrode.

In particular, the following procedure was followed:

1) 0.2500 grams of the neutralized polymer was placed in a 250 milliliter beaker and combined with 100 milliliters of an 80% by weight aqueous methanol solution.
2) 1 milliliter of 1 Molar $HClO_4$ (perchloric acid) solution was added to the beaker while stirring.
3) The sample solution was then titrated with 0.005 Molar $PbClO_4$ solution potentiometrically.
4) The differential end point was then accurately located by the maximum peak position of the first derivative of the titration curve.

The following results were obtained:

| % Solids <Final> | SMA-2000 Charge (A) | Moles Styrene (B) | 30% Oleum Charge | Moles RSO3H (C) | Mole % of Styrene Units Sulfo-nated (Actual) (D) | % of Styrene Units Sulfonated (Theo-retical) |
|---|---|---|---|---|---|---|
| 24.12 | 41.25#'s | 0.2693 | 6.00#'s | 0.0168 | 6.24 | 8.35 |
| 20.93 | 41.25#'s | 0.2693 | 6.00#'s | 0.0214 | 7.95 | 8.35 |

B = A × 0.6799/104.15
C = Moles H2SO4 charged* - Moles of SO4 in the batch (assumes theoretical batch weight recovered)
(* 30% Oleum charged × 1.0678/98.08)
D = C/B × 100
1 mL c(Pb perchlorate) = 0.005 mol/L ≅ 0.4803 mg $SO_4$ or 0.1603 mg S As shown above, between 6 mole percent and 8 mole percent of the styrene units were sulfonated during the process which is slightly below the theroretical calculation.

EXAMPLE 6

The following tests were conducted in order to demonstrate the ability of compositions made in accordance with the present invention to prevent nylon carpet samples from being stained.

White, undyed prescoured, nylon type 66 carpet samples (2×6 inches) were placed in a standard 9 inch PYREX dish and treated with a stain blocker composition made in accordance with the present invention to achieve a 200% wet pick up. The samples were then placed in a conventional microwave oven for 90 seconds set on medium/high power. After being removed from the microwave oven, the samples were rinsed thoroughly to remove excess stain blocker solution.

The stain blocker composition used in this example was as follows:

| Ingredient | Percent Amount |
|---|---|
| Sulfonated SMA-2000 Styrene Maleic Copolymer (2:1 Mole Ratio of Styrene to Maleic Units) | 67.0% |

-continued

| Ingredient | Percent Amount |
|---|---|
| DYEWELD ST Resin (Sybron Chemicals, Inc.) containing the sodium salt of a naphthalene sulfonate formaldehyde condensation product with dihydroxyldiphenylsulfone | 14% |
| TANAPURE AC Surfactant (Sybron Chemicals, Inc.) | 19% |

The above stain blocker composition was added to water and applied at a concentration listed in the following table. In some of the tests, magnesium chloride was added to the aqueous solution in order to act as a metal donor. Further, in some tests, the pH was lowered by adding an acid to the solution.

Eight different carpet samples were treated and tested. The pH of the solution used to treat sample numbers 4, 6, and 8 was lowered by adding citric acid. The pH of the solution used to treat sample number 7, however, was lowered using a urea/sulfuric acid mixture or other acid combinations such as sulfuric/formic or sulfuric/phosphoric.

After the samples were treated with the stain blocker solution, the samples were thoroughly dried and then treated with a solution of cherry-flavored KOOL-AID, which contains FD&C Red Dye #40. Each sample was held in the dye solution at 150° F. for 1 minute, rinsed, dried and rated for stain performance according to AATCC test procedures. The stain rating scale goes from 1 to 10, with 1 indicating the most amount of staining while 10 indicating the least amount of staining. The following results were obtained:

| Sample No. | Stain Blocker Conc. (g/l) | MgCl conc. (g/l) | initial pH | Final pH if Adjusted | Stain Rating (AATCC 175–1993) |
|---|---|---|---|---|---|
| 1 Control | — | — | — | — | 1.0 |
| 2 | 10 | — | 7.1 | — | 1.5 |
| 3 | 10 | 2 | 6.3 | — | 7.0 |
| 4 | 10 | 2 | 6.3 | 1.9 | 9.0 |
| 5 | 8 | 2 | 6.4 | — | 6.0 |
| 6 | 8 | 2 | 6.3 | 1.9 | 8.0 |
| 7 | 8 | 2 | 6.3 | 1.9 | 7.0 |
| 8 | 5 | 2 | 6.3 | 1.9 | 6.0 |

As shown above, the stain blocking composition of the present invention was very effective in preventing the samples from being stained by the red dye. As also shown above, the addition of magnesium chloride was necessary in this embodiment for the stain blocker composition to work effectively. As also shown in the above table, when magnesium chloride was present, a significant improvement in performance was seen.

EXAMPLE 7

The test described in Example number 6 was repeated. In this example, however, the carpet samples were dyed dark gold prior to being treated with the stain blocker composition. The following results were obtained:

| Sample No. | Stain Blocker Conc. (g/l) | MgCl conc. (g/l) | initial pH | Final pH if Adjusted | Stain Rating (AATCC 175–1993) |
|---|---|---|---|---|---|
| 1 Control | — | — | — | — | 1.0 |
| 2 | 10 | — | 7.1 | — | 1.5 |
| 3 | 10 | 2 | 6.3 | — | 7.0 |
| 4 | 10 | 2 | 6.3 | 1.9 | 9.0 |
| 5 | 8 | 2 | 6.4 | — | 6.0 |
| 6 | 8 | 2 | 6.3 | 1.9 | 8.0 |
| 7 | 8 | 2 | 6.3 | 1.9 | 7.0 |
| 8 | 5 | 2 | 6.3 | 1.9 | 6.0 |

EXAMPLE 8

The test described in Example 6 above was repeated on white, undyed carpet samples. In this example, however, a fluorocarbon polymer was added to the stain blocker solution in some of the tests as indicated in the table below. In sample numbers 4 and 5, the stain blocker composition of the present invention was also changed. Specifically, in these samples, the stain blocker composition contained 67% by weight of the addition polymer, 14% by weight of the sulfonated novolak resin, and 19% by weight of the anionic surfactant. In all of the tests, the pH of the solution was adjusted with citric acid to a pH of 1.9.

Further, in this example, each of the samples were tested for lightfastness according to AATCC test method 16-1993. According to the lightfastness test, the samples were exposed to ultraviolet light for 20 hours and then 40 hours. Once exposed to the ultraviolet light, the samples were then rated for fading.

The following results were obtained:

| Sample No. | Stain-Blocker conc. (g/l) | Flouro-carbon conc. (g/l) | MgCl conc. (g/l) | Stain rating (AATCC 175-1993) | Light fastness 20 hours | Light fastness 40 hours |
|---|---|---|---|---|---|---|
| 1 | 10 | — | 2 | 9/10 | no change | slight change |
| 2 | 10 | 3 | 2 | 9/10 | no change | no change |
| 3 | 12 | — | 2 | 10 | no change | very slight change |
| 4 | 10 | — | 2 | 9 | no change | very slight change |
| 5 | 10 | 3 | 2 | 10 | no change | slight change |

During this example, it was noted that the stain blocker solution of the present invention was completely compatible with the fluorocarbon polymer.

As shown in the above table, the stain blocker composition of the present invention was effective in preventing the samples from being stained. The samples were also shown to have good lightfastness characteristics.

EXAMPLE 9

The tests conducted in Example 8 were repeated using nylon carpet samples that were dyed dark gold. The following results were obtained:

TABLE IV

| Sample No. | Stain-Blocker conc. (g/l) | Flouro-carbon conc. (g/l) | MgCl conc. (g/l) | Stain rating (AATCC 175–1993) | Light fastness 20/40 hours |
|---|---|---|---|---|---|
| 1 | 10 | — | 2 | 10 | no change |
| 2 | 10 | 3 | 2 | 10 | no change |
| 3 | 12 | — | 2 | 10 | no change |
| 4 | 10 | — | 2 | 10 | no change |
| 5 | 10 | 3 | 2 | 10 | no change |

EXAMPLE 10

In this example, carpet samples were treated similar to the procedures described in Example 6. In this example, however, the samples underwent a shampoo wash durability test which tests the durability of the stain blocker composition.

In this example, the stain blocker composition that was used is the same as listed in Example 6. Instead of being placed in a microwave oven, however, the stain blocker solution was sprayed on the samples and the samples were then contacted with steam.

The shampoo test (wash durability test) that was conducted on the carpet samples conformed to a carpet industry test method. In this test, the samples were submerged for 5 minutes at room temperature in a detergent solution consisting of DUPONOL WAQE (1.5 g/l) and adjusted with dilute sodium carbonate to a pH of about 10.0. The samples were then removed, rinsed thoroughly under tap water, de-watered by squeezing and air-dried. The samples were then tested for a resistance to staining by the stain test method described in Example 6.

The following results were obtained:

TABLE V

| Sample No. | Stain-Blocker conc. (g/l) | MgCl conc. (g/l) | Fluoro-carbon conc. (g/l) | PH | Steam-Time (min) | Shampoo Test Results |
|---|---|---|---|---|---|---|
| 1 | 10 | 2 | 0 | 2.03 | 2.0 | 10 |
| 2 | 10 | 3 | 0 | 2.03 | 2.0 | 9 |
| 3 | 10 | 3 | 6 | 2.03 | 4.0 | 8 |
| 4 | 10 | 2 | 0 | 2.03 | 2.0 | 8 |
| 5 | 10 | 3 | 0 | 2.03 | 2.0 | 9 |
| 6 | 10 | 3 | 6 | 2.03 | 4.0 | 7 |
| 7 | 10 | 2 | 0 | 2.03 | 4.0 | 9 |
| 8 | 10 | 2 | 0 | 2.03 | 4.0 | 9 |
| 9 | 10 | 3 | 6 | 2.03 | 2.0 | 6 |
| 10 | 10 | 3 | 6 | 2.03 | 2.0 | 8 |
| 11 | 10 | 3 | 0 | 2.0 LPHN | 2.0 | 9 |
| 12 | 10 | 3 | 0 | 2.0 LPHN | 2.0 | 9 |
| 13 (CONTROL) | 0 | 0 | 0 | — | 2.0 | 6 |

As shown above from the shampoo test, the stain blocker formulation of the present invention has good durability characteristics.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A stain blocking composition adapted to bind to available dye sites contained in a polyamide material for making the polyamide material stain resistant, said composition comprising:

an addition polymer comprising a partially sulfonated styrene-maleic copolymer in combination with a sulfonated novolak resin and a metal donor wherein from about 2 mole percent to about 20 mole percent of the styrene contained within salt styrene-maleic copolymer is sulfonated.

2. A stain blocking composition as defined in claim 1, wherein said addition polymer is formed by partially sulfonating a styrene-maleic anhydride copolymer and then hydrolyzing said copolymer.

3. A stain blocking composition as defined in claim 1, wherein said addition polymer comprises a metal salt of said partially sulfonated styrene-maleic copolymer.

4. A stain blocking composition as defined in claim 1, wherein said metal donor comprises a magnesium salt.

5. A stain blocking composition as defined in claim 1, further including an anionic dispersant.

6. A stain blocking composition as defined in claim 1, wherein said partially sulfonated styrene-maleic copolymer contains styrene and maleic acid in a molar ratio ranging from about 1:1 to about 3:1, respectively.

7. A stain blocking composition as defined in claim 4. wherein said magnesium salt comprises magnesium chloride.

8. A stain blocking composition as defined in claim 1, wherein said novolak resin, said metal donor, and said addition polymer are contained in an aqueous solution, said novolak resin being present within said solution in an amount from about 0.5 to 2 grams/liter, while said addition polymer is present in said solution in an amount from about 4 to 8 grams/liter.

9. A stain blocking composition as defined in claim 1, further comprising a fluorocarbon polymer.

10. A stain blocking composition adapted to bind to available dye sites contained in a polyamide material for making the polyamide material stain resistant, said composition comprising:

an aqueous solution containing a sulfonated novolak resin, a metal salt comprising an aluminum salt or a magnesium salt, and an addition polymer, said addition polymer comprising a partially sulfonated styrene-maleic copolymer, said addition polymer being formed by partially sulfonating and hydrolyzing a styrene-maleic anhydride copolymer wherein from about 2 mole percent to about 20 mole percent of the styrene contained within salt styrene-maleic copolymer is sulfonated.

11. A stain blocking composition as defined in claim 10, wherein said addition polymer comprises a metal salt of said partially sulfonated styrene-maleic copolymer.

12. A stain blocking composition as defined in claim 10, further comprising a dispersant, said dispersant comprising an arylalkyl sulfonate salt.

13. A stain blocking composition as defined in claim 11, wherein said partially sulfonated styrene-maleic copolymer contains styrene and maleic acid in a molar ratio ranging from about 1:1 to about 3:1, respectively.

14. A stain blocking composition as defined in claim 12, wherein said novolak resin, magnesium salt, and said addition polymer are contained in an aqueous solution having a pH of less than about 4, said novolak resin being present within said aqueous solution in an amount less than about 3% by weight, while said addition polymer is present in said aqueous solution in an amount from about 8% to about 15% by weight.

15. A stain blocking composition as defined in claim 10, wherein said partially sulfonated styrene-maleic copolymer contains from about 25 mole percent to about 50 mole percent maleic acid, from about 50 mole percent to about 75 mole percent styrene, and from about 2 mole percent to about 10 mole percent sulfonated styrene.

16. A stain blocking composition as defined in claim 10, wherein said magnesium salt comprises a material selected from the group consisting of magnesium chloride, magnesium acetate, magnesium nitrate, magnesium sulfamate, magnesium dyhydrogen phosphate, magnesium sulfate, and mixtures thereof.

17. A stain blocking composition as defined in claim 10, further comprising a fluorocarbon polymer.

18. A process for producing stain resistant polyamide products comprising the steps of:

providing a polyamide substrate containing available dye sites; and contacting said polyamide substrate with an aqueous solution containing a composition which binds to said available dye sites, said composition including:

i) a sulfonated novolak resin;

ii) a magnesium salt; and iii) an addition polymer comprising a partially sulfonated and hydrolyzed styrene-maleic anhydride copolymer wherein from about 2 mole percent to about 20 mole percent of the styrene contained within salt styrene-maleic copolymer sulfonated.

19. A process as defined in claim 18, wherein said styrene-maleic anhydride copolymer is sulfonated such that sulfonate groups are located in the para and the ortho positions on styrene contained within said copolymer.

20. A process as defined in claim 18, wherein said composition further includes a dispersant comprising an arylalkyl sulfonate salt.

21. A process as defined in claim 18, wherein said addition polymer is present within said aqueous solution in an amount from about 8% to about 15% by weight.

22. A process as defined in claim 18, wherein said partially sulfonated and hydrolyzed styrene-maleic anhydride copolymer contains styrene and maleic acid in a molar ratio in a range from about 1:1 to about 3:1 respectively.

23. A process as defined in claim 18, wherein said partially sulfonated and hydrolyzed styrene-maleic anhydride copolymer contains from about 25 mole percent to about 50 mole percent maleic acid, from about 50 mole percent to about 75 mole percent styrene, and from about 2 mole percent to about 10 mole percent sulfonated styrene.

24. A process as defined in claim 18, wherein said polyamide substrate is made from nylon.

25. A process as defined in claim 18, wherein said composition further comprises a fluorocarbon polymer.

26. A stain resistant polyamide product comprising:

a polyamide substrate; and a stain blocking composition bound to available dye sites located on said polyamide substrate, said stain blocking composition comprising:

i) a sulfonated novolak resin; and ii) an addition polymer comprising a styrene-maleic copolymer having the following repeat units:

wherein from about 2 mole percent to about 20 mole percent of the styrene contained in said copolymer has been sulfonated;

iii) a metal donor.

27. A stain resistant polyamide product as defined in claim 26, wherein said sulfonate groups are located at the ortho and para positions on said styrene contained within said styrene-maleic copolymer.

28. A stain resistant polyamide product as defined in claim 26, wherein said styrene-maleic copolymer contains styrene and maleic acid in a molar ratio of from about 1:1 to about 3:1 respectively.

29. A stain resistant polyamide product as defined in claim 26, wherein said addition polymer comprises from about 25 mole percent to about 50 mole percent maleic acid, from about 50 mole percent to about 75 mole percent styrene and from about 2 mole percent to about 10 mole percent sulfonated styrene.

30. A stain resistant polyamide product as defined in claim 26, wherein said polyamide substrate comprises nylon.

31. A stain resistant polyamide product as defined in claim 26, wherein said polyamide substrate comprises carpeting.

32. A stain resistant polyamide product as defined in claim 26, further comprising a fluorocarbon repellent coating covering said polyamide substrate.

* * * * *